US011328830B2

(12) United States Patent
Sahai et al.

(10) Patent No.: US 11,328,830 B2
(45) Date of Patent: May 10, 2022

(54) METHOD AND APPARATUS FOR PROCESSING A PARTICLE SHOWER USING A LASER-DRIVEN PLASMA

(71) Applicants: Aakash Sahai, Denver, CO (US); Praveer Gupta, Eatontown, NJ (US)

(72) Inventors: Aakash Sahai, Denver, CO (US); Praveer Gupta, Eatontown, NJ (US)

(73) Assignees: Aakash Sahai, Denver, CO (US); Praveer Gupta, Denver, CO (US)

( * ) Notice: Subject to any disclaimer, the term of this patent is extended or adjusted under 35 U.S.C. 154(b) by 75 days.

(21) Appl. No.: 16/770,943

(22) PCT Filed: Dec. 10, 2018

(86) PCT No.: PCT/US2018/064806
§ 371 (c)(1),
(2) Date: Jun. 8, 2020

(87) PCT Pub. No.: WO2019/113604
PCT Pub. Date: Jun. 13, 2019

(65) Prior Publication Data

US 2020/0335237 A1 Oct. 22, 2020

Related U.S. Application Data

(60) Provisional application No. 62/757,041, filed on Nov. 7, 2018, provisional application No. 62/756,581, filed
(Continued)

(51) Int. Cl.
*G21K 1/02* (2006.01)
*H05H 1/54* (2006.01)
(Continued)

(52) U.S. Cl.
CPC ..... *G21K 1/02* (2013.01); *H05H 1/54* (2013.01); *H05H 15/00* (2013.01); *H05H 9/00* (2013.01)

(58) Field of Classification Search
CPC ..... G21K 1/02; H05H 1/54; H05H 15/00; H05H 9/00
See application file for complete search history.

(56) References Cited

U.S. PATENT DOCUMENTS 6,906,338 B2 6/2005 Tajima
8,299,713 B2 10/2012 Hooker et al.
(Continued)

OTHER PUBLICATIONS

Sahai, "On Certain Non-linear and Relativistic Effects in Plasma-based Particle Acceleration", 2016, PhD Dissertation (Year: 2016).*
(Continued)

*Primary Examiner* — Borna Alaeddini
(74) *Attorney, Agent, or Firm* — Praveer K Gupta

(57) ABSTRACT

A method and apparatus for processing a particle shower using a laser-driven plasma is provided. The method comprises interacting a particle shower with a processing laser-driven plasma stage, the particle shower comprising at least one particle species, wherein the laser is a high-energy, ultra-short pulse laser. In some embodiments, the method comprises accelerating, decelerating, trapping, or collimating the at least one particle species in the processing laser-drive plasma stage. Particularly, the embodiments enable generating high energy particle beams that were only possible using accelerators spanning several hundred meters, in a space of a few meters.

15 Claims, 7 Drawing Sheets

Related U.S. Application Data on Nov. 6, 2018, provisional application No. 62/619,747, filed on Jan. 20, 2018, provisional application No. 62/596,265, filed on Dec. 8, 2017.

(51) Int. Cl.
*H05H 15/00* (2006.01)
*H05H 9/00* (2006.01)

(56) References Cited

U.S. PATENT DOCUMENTS

| | | | | |
|---|---|---|---|---|
| 9,863,975 | B2 * | 1/2018 | Miles | G01P 5/001 |
| 2016/0260578 | A1 * | 9/2016 | Sossong | G01V 5/0016 |
| 2019/0064374 | A1 * | 2/2019 | Varga | G01V 5/00 |

OTHER PUBLICATIONS

Adli et al., "A Beam Driven Plasma-Wakefield Linear Collider: From Higgs Factory to Multi-TeV", 2013, SLAC-PUB-15426 (Year: 2013).*

Leemans et al., "Laser-driven plasma-wave electron accelerators", 2009 (Year: 2009).*

Sarri et al., "Generation of neutral and high-density electron-positron pair plasmas in the laboratory", 2015 (Year: 2015).*

Takeda et al., "Electron Linac of Test Accelerator Facility for Linear Collider", 1990 (Year: 1990).*

Sahai, "Positron Acceleration using Plasma-based accelerators", Mar. 14, 2017, also available on YouTube.com: https://www.youtube.com/watch?v=VMcUsqyZJe4 (Year: 2017).*

FACET-II, "FACET-II Facility for Accelerator Science and Experimental Test Beams-II Located in the SLAC Linac at Sector 10", Apr. 2, 2013 (Year: 2013).*

Hast et al., "Facet: The new user facility at SLAC", 2011, ResearchGate (Year: 2011).*

Esarey et al., "Physics of laser-driven plasma-based electron accelerators", 2009, Modern Physics, vol. 81 (Year: 2009).*

Alexander ("Scintillation Light Detection and Application of Silicon Photomultipliers in Imaging Calorimetry and Positron Emission Tomography"; Published: Dec. 14, 2011) (Year: 2011).*

Van de Wetering ("Formation and dynamics of nanoparticles in plasmas"; Technische Universiteit Eindhoven; thesis; published: Feb. 2016) (Year: 2016).*

Wu et al. ("Optimization of positrons generation based on laser wakefield electron acceleration"; published: Aug. 2016) (Year: 2016).*

Doche et al., Acceleration of a trailing positron bunch in a plasma wakefield accelerator SScientific reports, Oct. 27, 2017, 7(1);14180(Oct. 2017), abstract; Fig1, p. 1,2,5.

Sahai"A Laser-Plasma Positron Accelerator using Particle-Shower Plasma-Wave interactions" No. arXiv; 1801.06385, 2018, Jan. 19, 2018.

International Search Report on Application No. PCT/US2018/64806 dated Mar. 8, 2019.

* cited by examiner

METHOD AND APPARATUS FOR PROCESSING A PARTICLE SHOWER USING A LASER-DRIVEN PLASMA

CROSS-REFERENCE TO RELATED APPLICATIONS

This application claims priority to the U.S. Provisional Application Ser. No. 62/596,265, filed on 8 Dec. 2017; U.S. Provisional Application Ser. No. 62/619,747, filed on 20 Jan. 2018; U.S. Provisional Application Ser. No. 62/756,581, filed on 6 Nov. 2018; and U.S. Provisional Application Ser. No. 62/757,041, filed on 7 Nov. 2018, each of which is hereby incorporated by reference in its entirety.

BACKGROUND

Field of the Invention

Embodiments of the present invention generally relate to techniques for processing sub-atomic particles, and more specifically to method and apparatus for processing a particle shower using a laser-driven plasma.

Background

Generating high energy sub-atomic particles is a challenge, and typically requires huge installations spanning several hundreds or thousands of meters, and several hundred million dollars in costs. Such facilities are not easily accessible of affordable, and severely restrict availability of such particles for experimentation or applications.

Therefore, there exists a need for an improved method and apparatus for processing particles from a particle shower.

SUMMARY

The present invention relates generally to a method and apparatus for processing a particle shower using a laser-driven plasma is provided. The method comprises interacting a particle shower with a processing laser-driven plasma stage, the particle shower comprising at least one particle species, wherein the laser is a high-energy, ultra-short pulse laser. In some embodiments, the method comprises accelerating, decelerating, trapping, or collimating the at least one particle species in the processing laser-drive plasma stage.

BRIEF DESCRIPTION OF THE DRAWINGS

So that the manner in which embodiments of the present invention can be understood in detail, a more particular description of the invention may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 10 is a schematic diagram of an apparatus for processing a particle shower using a laser-driven plasma, according to an embodiment of the present invention.

DETAILED DESCRIPTION

Embodiments of the present invention comprise a method and apparatus for processing a particle shower using a laser-driven plasma. More specifically, the techniques disclosed herein enable trapping at least one or more particle species of a particle shower in a laser-driven plasma. The particle shower may be electromagnetic comprising of particles, such as electrons and positrons, or the shower may be hadronic in nature comprising of particles, such as, muons, pions, among other particles. The laser-driven plasma is typically generated in a gaseous medium comprising a gas. The laser is an ultra-short tens of femto-second laser such as a Chirp-pulse Amplified laser with a Ti:Sapphire or a Nd:Glass or a Carbon diOxide active medium, and can be further configured to drive the plasma to collimate, accelerate, decelerate or suspend the trapped particles. It is theorized that the laser excites the plasma to form certain types of traveling structures in the plasma which sustain electron-ion charge separation with associated electromagnetic fields therein to trap, collimate and accelerate particles from the particle shower. In some embodiments, the laser and plasma can be configured to decelerate particles, or even suspend particles in the plasma. The electromagnetic fields of the traveling charge separation structures in the plasma exert a force on the charged particles of the particle shower, and thus process them inside the plasma. The electromagnetic fields of these structures in the plasma tuned to collimate the particles by exerting a focusing force that keeps them together in opposition to their initial transverse velocities. Further, the laser electromagnetic fields may be tuned to generate one or more plasma waves, which are an outcome of alternating regions of electron density compression and depletion due to the laser radiation pressure driven motion of the electrons against the stationary ions, and the plasma waves can be configured to add energy to the particles, accelerating the particles; reduce the energy by opposing the motion of the particles, decelerating the particles; or neither add nor reduce the energy of the particles. The laser-driven plasma stage is implemented in a space spanning less than 1 meter, and as small as 0.5 millimeter.

The solutions rely on the use of a generated particle shower, for example using several known techniques, such as positron-electron pair production by decay of high-energy photon; nuclear decay; proton-proton collision among others. A few such techniques relevant to electromagnetic showers, among other functionalities, technical details and applications, is discussed in the publication titled Sahai, Aakash A., "Quasimonoenergetic laser plasma positron accelerator using particle-shower plasma-wave interactions," *Phys. Rev. Accel. Beams* 21, 081301, 8 Aug. 2018, incorporated herein by reference in its entirety.

Figure 1A:
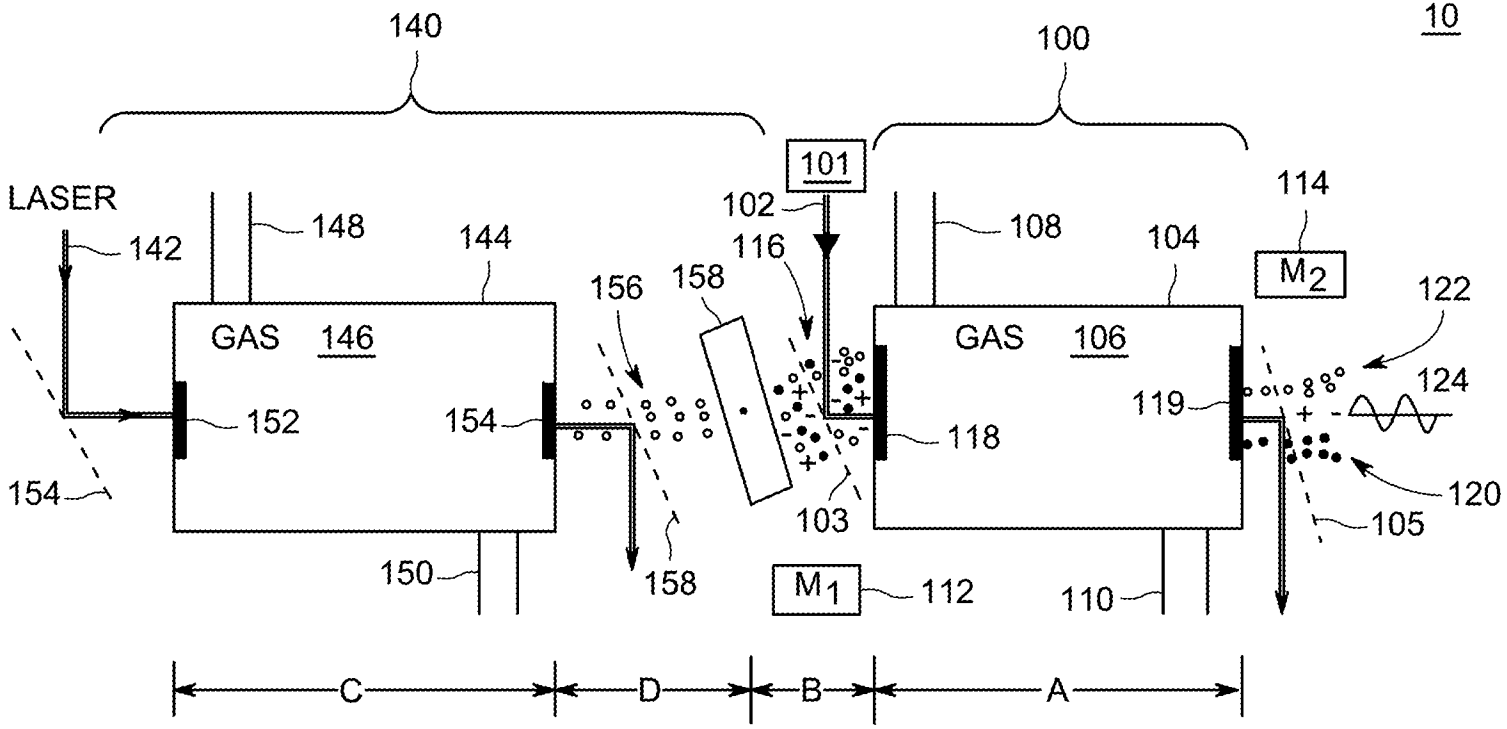
FIG. 1A is a schematic diagram of an apparatus for processing a particle shower using a laser-driven plasma, according to an embodiment of the present invention.

FIG. 1A is a schematic diagram of an apparatus 10 for processing a particle shower using a laser-driven plasma, according to an embodiment of the present invention. The apparatus 10 comprises a processing stage 100 for processing particle species captured or trapped from a particle shower 116, and a feeder stage 140 for generating the particle shower 116 supplied to the processing stage 100.

The processing stage 100 comprises a laser source and a focusing optics 101 capable of providing an ultra-short laser 102, with 500 mJ to 50 J of energy, 10-60 fs pulse length and a focused spot-size ranging from 10-250 microns, and a chamber 104 for a gas 106, the chamber 104 having controllable inlet 108 and controllable outlet 110 for gas 106, and windows 118 and 119 configured for entry and exit of the laser 102 into and from the chamber 104, respectively. The window 118 is also configured for entry of the particle shower 116 into the chamber 104 and the plasma in the gas 106 therein. The processing stage 100 also includes a mirror 103 to direct the laser 102 to the gas 106, for example, into the chamber 104 through the window 118.

When the particle shower is being processed by a plasma in the gas 106, the inlet 108 and the outlet 110 are configured to be sealed, for example by corresponding valves (not shown). When more gas 106 is needed in the chamber 104, the inlet 108 and/or the outlet 110 may be opened. The open and shut states of the inlet 108 and the outlet 110 are managed according to when gas in needed to be introduced in the chamber 106, for example to maintain the pressure in the chamber 106.

The gas 106 has a tunable atomic weight, and includes, for example, Helium, Methane, Nitrogen, Neon, or other gases having low atomic weight, among others. A pressure ranging between 500 Pascals to 500 kilo Pascals is maintained in the chamber 104.

The windows 118 and 119 are made from materials that provide minimal deterioration of the properties of the laser 102 and/or the particles from the particle shower 116 and suffer minimal damage from the laser and the particle shower particles. For example, the windows 118, 119 are made from one or more of silica or other material transparent to laser radiation.

The mirror 103 is a thin replaceable metal in the form of a ribbon or a foil, for example, aluminum or copper. The mirror 103 selectively reflects the laser 102 at a desirable angle, while causing minimal obstruction to or deterioration of the particles of the particle shower 116.

The particles trapped from the particle shower 116 are processed by the plasma driven by the laser 102, in the gas 106, inside the chamber 104, and emerge from of the chamber 104, for example, in one or more beams, for example, beam 120 and 122, and additional radiation or particles 124 which may or may not be in form of a beam 124. For example, in the illustration of FIG. 1A, the particle shower 116 is an electromagnetic particle shower comprising electrons and positrons, which is processed by the plasma formed in the gas 106 by the laser 102. The beam 120 is a positron beam, and the beam 122 is an electron beam. The positron beam 120 has a spot size or radius ranging from a 1 to 100 microns, a bunch length of 1 to 100 microns with >5000 particles in a peak in the energy spectrum. The electron beam 122 has a spot size or radius of 1 to 100 microns, and bunch length of 1 to 100 microns with >5000 particles in a peak in the energy spectrum. The positron beam 120 and the electron beam 122 are separated by a distance of about 10 to 100 microns. The additional radiation and/or particles 124 may include photons, or low energy electrons.

In one embodiment, the processing stage 100 is configured to trap, collimate and accelerate the oppositely charged particles from the particle shower. The laser 102 is configured to an energy of about 5 J, pulse length 50 fs and spot-size with full-width at half-maximum of 40 microns, the gas is configured at pressure of 5 kilo Pascals over its length ranging between 1 to 10 millimeters. The oppositely charged particles of particle shower are trapped and accelerated to approximately similar energy levels, and emerge as beams. For example, the positrons in the particle shower are accelerated in the gas 104 plasma and emerge as the positron beam 120 having an energy peak around 170 MeV, bunch length of 10 microns and spot-size of 10 microns at the exit with an opening angle of around 5 milli-radians with the particle energy spectra peaked at 170 MeV with a full-width at half-maximum width of <10 percent containing at least 50,000 particles.

In one embodiment, the processing stage 100 is configured to trap, collimate and decelerate the oppositely charged particles from the particle shower 116. Laser parameters are the same as above but spot-size of 10 to 50 microns and the gas pressure is between 200 and 500 kilo Pascals.

In one embodiment, the processing stage 100 is configured to trap and collimate the oppositely charged particles from the particle shower 116, without adding or reducing energy of the particles. In this embodiment, the laser has the same set of parameters but a spot-size of 100-250 microns, the —and the gas 106 has a pressure of 100-1000 Pascals.

In one embodiment, the particle shower 116 is a hadronic particle shower comprising muons and pions and the beam 120 is a positive muon beam, while the beam 122 is a negative muon beam. The positive muon beam 120 has a spot size or radius of 1-100 microns, and bunch length between 1-100 microns any other properties. The negative muon beam 122 has a spot size or radius of 1-100 microns, bunch length between 1-100 microns. The positive muons beam 120 and the negative muon beam 122 are separated by a distance of about 10 to 100 microns. The additional radiation and/or particles 124 may include photons, and high energy electrons and positrons.

In one embodiment, the laser 102 exits the chamber 104 from the window 119, and is directed away from the particles and/or the radiation (e.g., 120, 122, 124) emitted out of the chamber 104, for example, using a mirror 105, similar to the mirror 103, to reduce or eliminate interaction of the exiting laser 102 with the particles and/or the radiation emerging from the chamber 104. In one embodiment, the processing stage 100 does not include the mirror 103, and the source 101 is positioned to direct the laser 102 to the gas 106, for example, through the window 118, directly. In one embodiment, the processing stage 100 does not include the mirror 105.

In one embodiment, the processing stage 100 includes a first magnet 112 positioned to submerge the particle shower 116 or portion thereof in a magnetic field M1. The magnetic field M1 is configured to increase the flux portion of the particle shower 116 which enters the plasma in the gas 106. For example, the magnet 112 is a rare-earth metal magnet or an electromagnet with axial magnetic fields, and the magnetic field M1 varies from 1 to 10 Tesla.

In one embodiment, the processing stage 100 includes a second magnet 114 positioned to submerge the emerging particles 120, 122 or portion thereof in a magnetic field M2.

The magnetic field M2 is configured to direct the oppositely charged particle beams 120 and 122 apart from each other, for example, to utilize each of the two beams (120, 122) individually. For example, the magnet 114 is a dipole magnet, and the magnetic field M2 varies from 0.5 to 2.5 Tesla.

The feeder stage 140 comprises a laser 142, for example generated from a laser source (not shown) similar to the source 101, or generated from the laser source 101. The laser 142 is directed into a chamber 144 comprising a gas 146. The laser 142 generates a gas-plasma 146 in the gas 146, which generates high-energy electrons. The high-energy electrons emerge as a beam 156 from the chamber 144. The chamber 144 comprises a controllable gas inlet 148 and a gas outlet 150, which are used to maintain the gas 146 at a desired pressure inside the chamber 144. The laser 142 is directed into the chamber 144 by a mirror 154, and the laser 142 is directed away from the beam 156 by a mirror 158, where the mirrors 154, 158 are similar to the mirror 103. The electron beam 156 is directed to collide with a heavy (high atomic weight (Z)) metal target 158, and the interaction generates an electromagnetic particle shower. Hadronic shower is generated when a >280 MeV proton beam hits a metal target or a gas or a liquid. Such techniques to generate a particle shower are well known, and can be found in, for example, Electromagnetic shower—B. Richter, Design consideration for high energy electron-positron storage rings, SLAC-PUB-240, November (1966); Erikson, R. (ed.), SLAC Linear Collider Design Hand-book, ch. 5, SLAC-R-714 (1984); and Hadronic shower—E. Fermi, Progress of Theoretical Physics 5, Iss. 4, pp. 570-583, (1950); E. Cartlidge, Phys. World 19, iss. 12, p. 13 (2006)

The width of the chamber 104, or the length along the processing laser 102 in the gas plasma 106, approximately denoted by A, is between about 0.5 mm to 2 cm. The distance between the metal target 158 and the chamber 104 (or the window 118), approximately denoted by B is between about 100 microns to about 5 mm. The width of the chamber 144, approximately denoted by C, is between about 5 mm to about 100 mm. The length of the laser 142 in the gas plasma 146 is about 50 femtoseconds (approximately 15 microns). The distance between where the electron beam 156 emerges from the chamber 144 to the metal target 158, denoted approximately by D, is between about 0.5 mm to about 5 mm.

The largest dimension of the apparatus 10 of FIG. 1A, aside from the laser (102, 142) sources is smaller than one meter. Conventional Chirp-Pulse Amplified laser sources capable of generating the ultra-short laser utilized in the apparatus 10 have a size of a few (5-10) meters, and therefore, the entire apparatus 10 has the largest dimension smaller than 15 meters. The apparatus 10 is capable of generating positron beams over 10 MeV to several GeV, which has conventionally only been possible in production facilities spanning several hundred meters or kilometers, requiring investments of several hundreds of millions of dollars, and requiring several months or years to construct. In comparison, the apparatus 10 can fit in a small room, and can be assembled in a significantly shorter time and at a significantly lower cost, and represents a significant improvement over conventional particle processors such as RF particle accelerators.

Figure 1B:
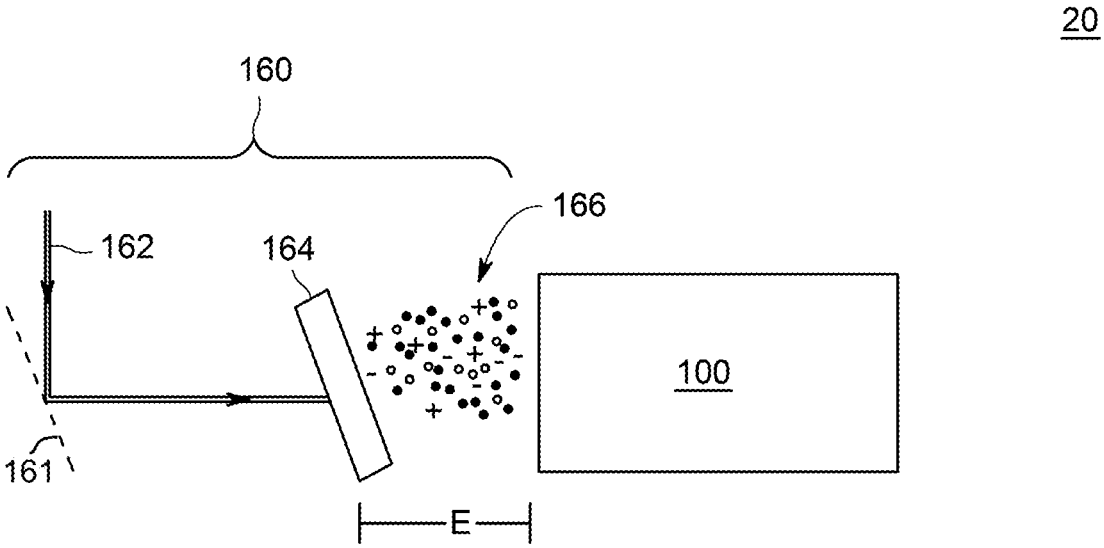
FIG. 1B is a schematic diagram of an apparatus for processing a particle shower using a laser-driven plasma, according to an embodiment of the present invention.
Figure 1C:
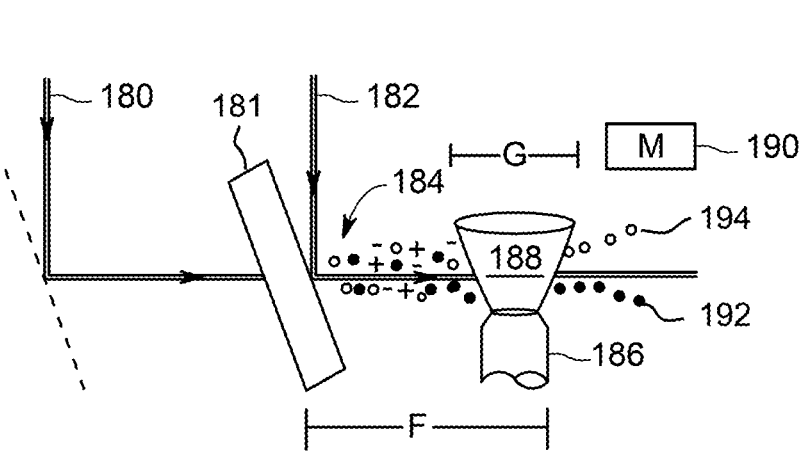

FIG. 1B is a schematic diagram of an apparatus 20 for processing a particle shower using a laser-driven plasma, according to an embodiment of the present invention. The apparatus 20 comprises a feeder stage 160 coupled with a processing stage, for example, the processing stage 100 of FIG. 1A. The feeder stage 160 comprises a laser 162, for example emitted using a source similar to the source 101, and directed to a heavy (high molecular weight Z) metal 164 target, using a mirror 161 similar to the mirror 103, for example. The laser 162 has tens of Joules to a few kJ of energy, pulse length between 100 fs to 25 picoseconds, and upon interaction with the metal target 164, generates a particle shower 166, which is then processed in the processing stage 100, for example as discussed above with respect to FIG. 1A. The distance between the metal target 166 and the processing stage 100 is approximately denoted by E, which is between about 0.2 mm to about 5 mm. Various examples of the feeder stage 160 is also described in literature, for example, T. Tajima, J. M. Dawson, Laser Electron Accelerator, *Phys. Rev. Lett.* 43, pp. 267-270 (1979); U.S. Pat. No. 5,637,966; and US Patent Publication 2017/0099724A1.

FIG. 10 is a schematic diagram of an apparatus 30 for processing a particle shower using a laser-driven plasma, according to an embodiment of the present invention. The apparatus 30 comprises a processing stage represented by a gas jet 186 releasing a jet of a gas 188, and a magnet 190 having a magnetic field M3; and a feeder stage defined by a first laser 180 generated by a source similar to the source 101, a second laser 182, generated by a laser source similar to the source 101, and a heavy metal target 181. The first laser 180 has tens of Joules to a few kJ of energy, pulse length between 100 fs to 25 picoseconds and focussed to a focal spot-size of 10 to 250 microns, and interacts with the metal target 181, and generates a particle shower 184. The second laser 182 has 0.5 J to 50 J of energy, pulse length between 10 fs to 1 ps and a focal spot-size of 10 to 100 microns, and interacts with the metal target 181 in the region from which the particle shower 184 is emitted, and processes the particle shower 184. The second laser 182 reflects off the metal target 181 and is directed to the gas 188 to generate a gas-plasma 188. The second laser 182 may accelerate the particles in the particle shower 184 and/or reduce the divergence of the particle shower 184, and increases the yield of the particles beams. The metal target 181 is at a distance from the jet of the gas 188, approximately denoted by F, which is between about 100 microns to about 5 mm. The proximity of the metal target 181 to the gas 188 and the gas-plasma 188 further increases the yield of the particle beams generated by the processing stage. In the apparatus 30, the processing stage does not confine the gas 188 in a chamber, unlike the processing stage 100. Instead, the gas jet 186 is configured to release a sufficient amount of gas 188 to generate a gas-plasma 188 therein. The laser 181 is timed such that as the particle shower 184 is generated, the laser 182 generate the gas-plasma 188, which traps the particle shower 184 or a portion thereof, and processes the trapped particles of the particle shower 184 in a manner similar to the processing stage 100, for example, collimating, accelerating, decelerating or suspending the particles therein. Upon processing of the particles in the gas-plasma 188 driven by the laser 182, at least two beams 192, 194 bearing opposite charges emerge out of the gas plasma 188, and may be separated from each other using the magnet 190, in a manner similar to the magnet 114 with respect to the processing stage 100.

It is theorized that the laser driven gas-plasma, for example, the gas-plasma 104 driven by the laser 102 in the apparatus 10, or the gas-plasma 188 driven by the laser 182 in the apparatus 30 generates electromagnetic fields in the respective gas-plasma. The gas-plasma is configured by the lasers to trap particles from particle showers therein. The trapping is an important property of the laser-driven gas-plasma described herein, because such trapping enables a reasonable population of particles for further processing, such as collimating and acceleration or deceleration. The gas-plasma driven by the laser develops plasma structures such as a plasma wave is also believed to have electromagnetic fields configured to collimate the particles. The gas-plasma can be configured to have electromagnetic fields which either accelerate or decelerate the particles trapped in the plasma.

For example, it is theorized that the gas-plasma driven by the ultra-short high-intensity laser as configured above has one or more plasma waves therein. The plasma wave is a spatial oscillation of electromagnetic fields in the plasma with alternating regions of electron density compression and evacuation. Similarly, the polarized electrons in the gas-plasma have electric fields which progressively accelerate positively charged particles trapped in the electric fields of the electrons within the gas-plasma. Particles of the particle shower co-propagating with the plasma wave witness the electromagnetic fields of the wave. In the regions where the electromagnetic fields are focusing for a particle species such as the electron compression regions for positrons in the shower, particles of the shower get trapped. Once trapped if the focusing region also has accelerating fields then the trapped particles get accelerated. The trapped particles are thereby accelerated by electromagnetic fields (of polarized ions and electrons) having a strength of approximately $10^{11}$ V/m for a plasma density of 1018 $cm^{-3}$, and emerge from the gas-plasma gaining a significant amount of energy from the plasma wave.

Forward propagating particles of the shower are trapped if the speed of the plasma wave, its amplitude and its shape is appropriately tuned. A quasi-nonlinear plasma wave with amplitude that is high enough to retain the trapped positive particles as they gain energy but not too high to shrink the positive particle trapping region spatially is demonstrated to be ideal if the positive particle species of the shower has to be trapped. The speed of the plasma wave chosen is demonstrated to depend upon the properties of the particle shower such as its energy spectrum. The shape of the plasma wave is dictated by the laser pulse focal spot which is tuned in consideration of the plasma density and laser intensity. An initially broad plasma wave will trap the shower particles over a larger transverse spatial region.

Figure 2A:
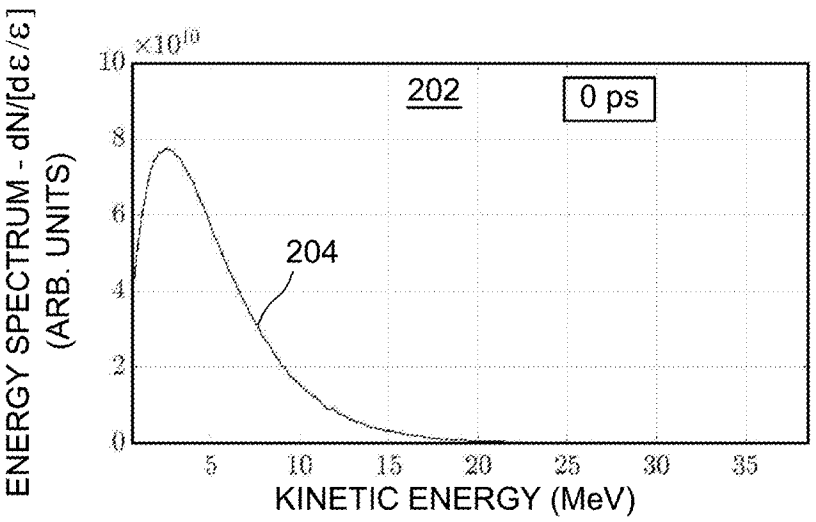
FIGS. 2A-2H depict the particle energy spectra, and particle longitudinal momentum vs. transverse momentum phase-spaces generated using particle-in-cell (PIC) simulations, according to an embodiment of the present invention.
Figure 2B:
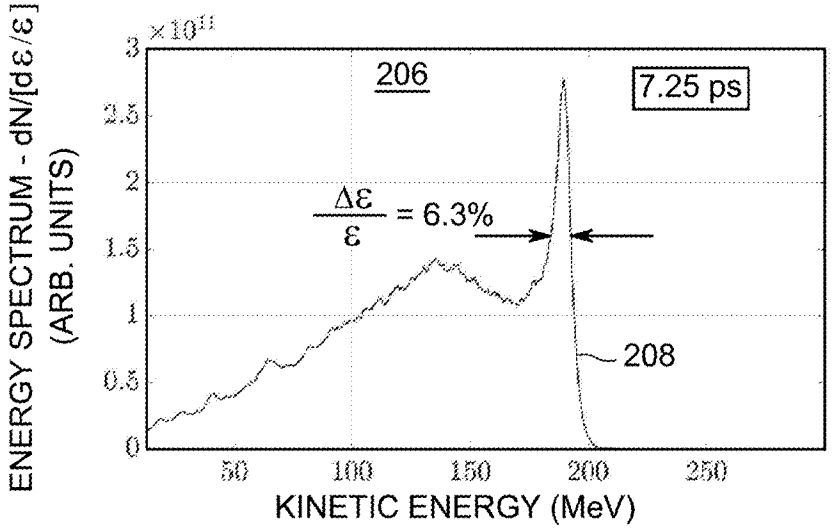
Figure 2C:
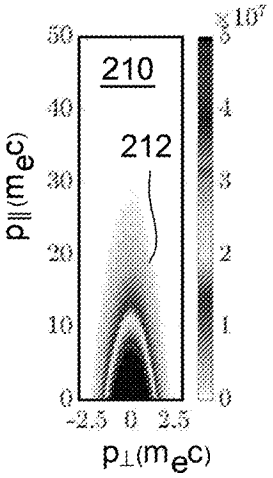
Figure 2D:
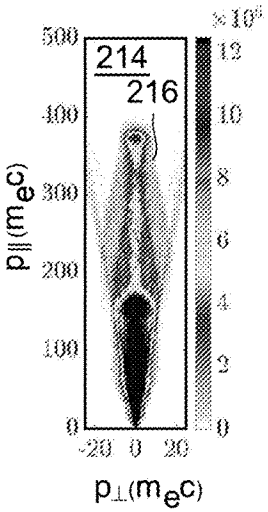
Figure 2G:
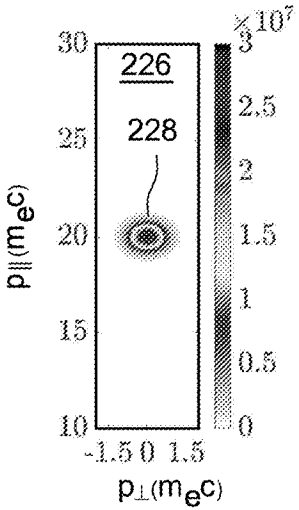
Figure 2H:
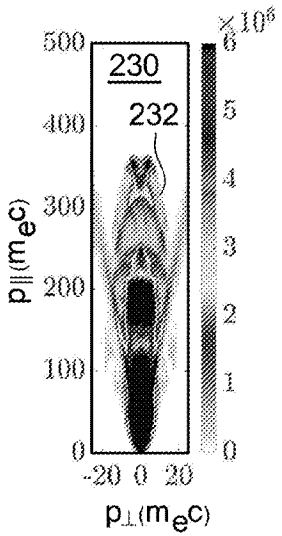
Figure 2E:
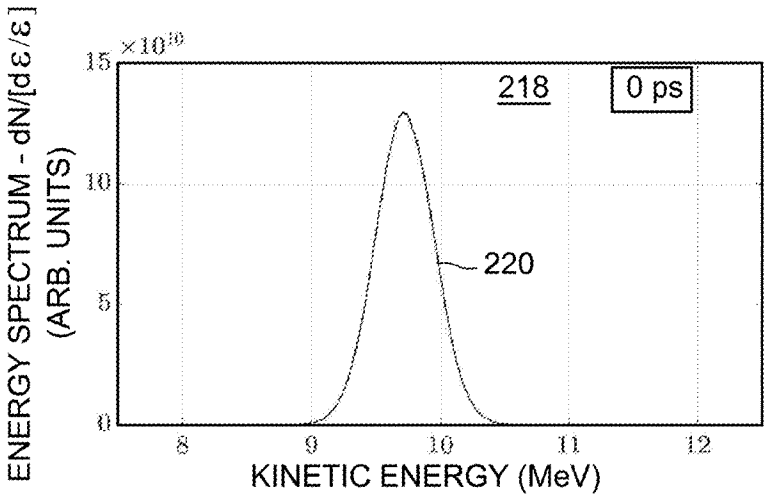
Figure 2F:
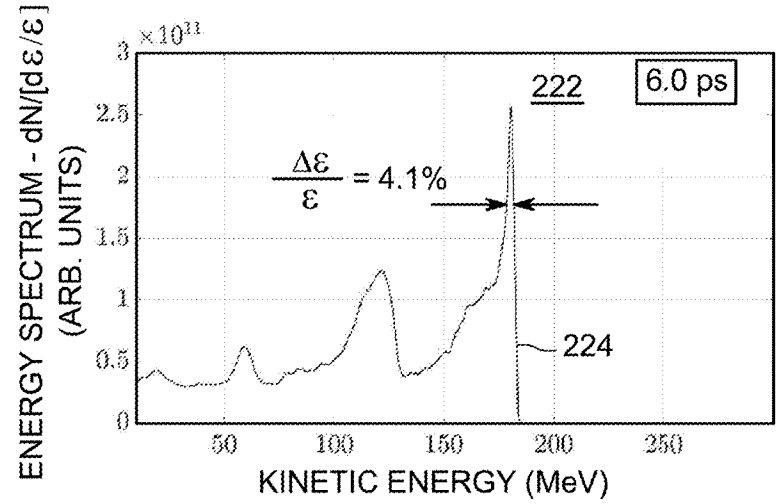
Figure 3A:
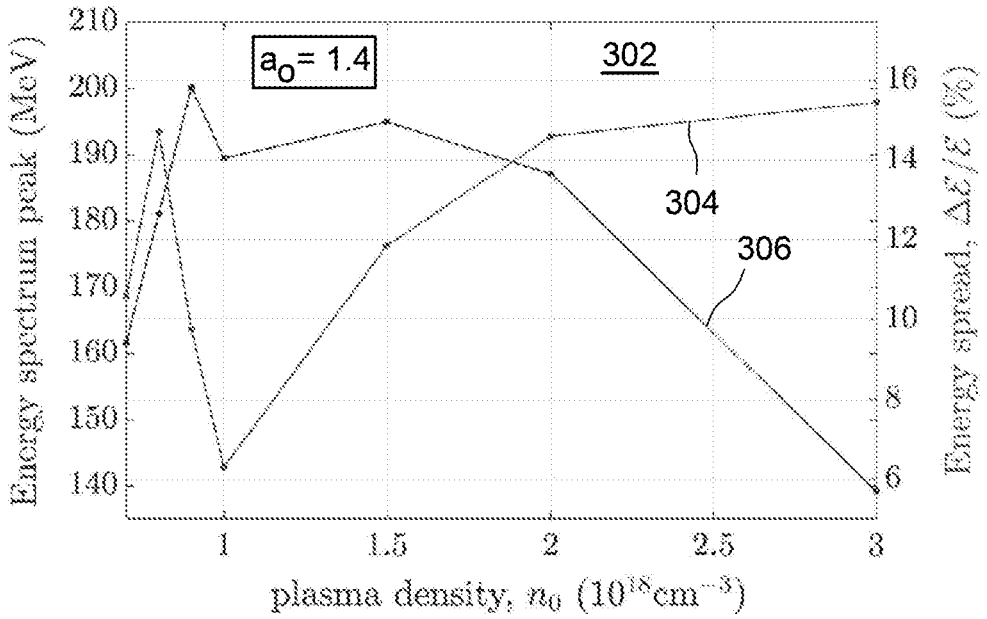
FIGS. 3A and 3B depict the variation of the energy spectral characteristics with respect to the laser-driven plasma of the processing stage 100 of FIG. 1A, according to an embodiment of the present invention.
Figure 3B:
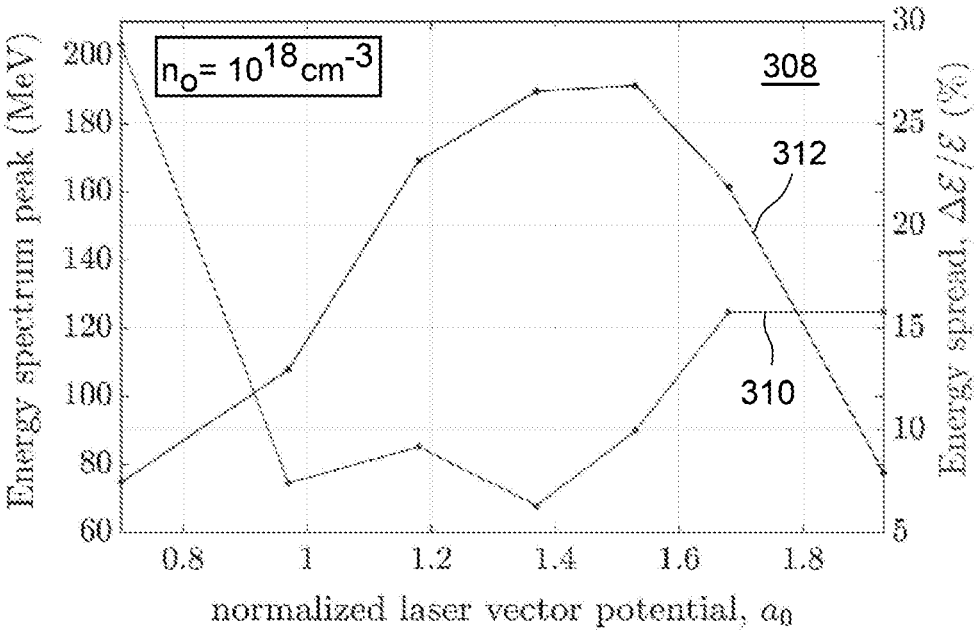

The phenomenon discussed above is supported by particle-in-cell (PIC) simulations, representations of which are presented in FIGS. 2A-2H, and FIGS. 3A and B. In FIG. 3A and FIG. 3B, it is also shown that the phenomenon discussed above works over a range of parameters around a local optimum for a given particle shower parameters.

FIGS. 2A-2H depict the particle energy spectra, and particle longitudinal momentum vs. transverse momentum phase-spaces generated using particle-in-cell (PIC) simulations. The parameters include plasma density $n_0=10^{18}$ $cm^{-3}$, ultra-short Chirp-Pulse Amplified laser pulse of pulse duration 50 femtoseconds (fs) with the strength or intensity parameter of $a_0=1.4$ and Full Width at Half Maximum (FWHM) spot-size to which the laser is focused down using a polished metallic mirror of 40 microns.

FIGS. 2A-2D pertain to the configuration of the processing stage 100 of FIG. 1A. FIGS. 2A and 2C depict the condition of the raw particle shower 116 at the entry point (0 pico-seconds position of the laser 102) of the gas-plasma 106, received from the feeder stage 140. Specifically, the graph 204 on the chart 202 of FIG. 2A (particle energy spectra) shows that a large number of particles in the particle shower are at a low energy, having a maxim, but not a peak. FIG. 2C depicts the longitudinal momentum vs. transverse momentum phase-spaces via a distribution 212 on the chart 210, showing a divergent particle shower. Similarly, FIG. 2B depicts the particle energy spectra chart 206 at the end of the laser-driven plasma stage (7.25 picoseconds (ps) position of the laser 102, or about 2.2 millimeters (mm)), for example, where the beams 120, 122 are obtained. The graph 208 clearly shows that a large number of particles are at a high-energy peak (of about 200 MeV). FIG. 2D, depicts the longitudinal momentum vs. transverse momentum phase-spaces via a distribution 216 on the chart 214.

FIGS. 2E-2H pertain to the configuration of the processing stage as described in the apparatus 30 of FIG. 10. The particle energy chart 218 graph 220 shows that just prior to entering the gas-plasma 188 (0 ps), the particle shower 184 has a large number of particles at low energy, approximately (<10.5 MeV), and the chart 226 shows the corresponding longitudinal momentum vs. transverse momentum phase-spaces. After being processed by the processing stage of apparatus 30, that is at 6 ps (or 1.8 mm), a large portion of the particle shower is accelerated to about 180 MeV, as shown in the chart 222, graph 224, and the chart 230, graph 232.

FIGS. 3A and 3B depict the variation of the energy spectral characteristics with respect to the laser-driven plasma of the processing stage 100 of FIG. 1A. FIGS. 3A and 3B depict the variation of the peak energy of the beam (on the left axis) and the full-width half-maximum energy spread (on the right axis) of the positron beam 120 from a PIC simulation, varied with $n_0$ in FIG. 3A, and with $a_0$ in FIG. 3B.

Figure 4A:
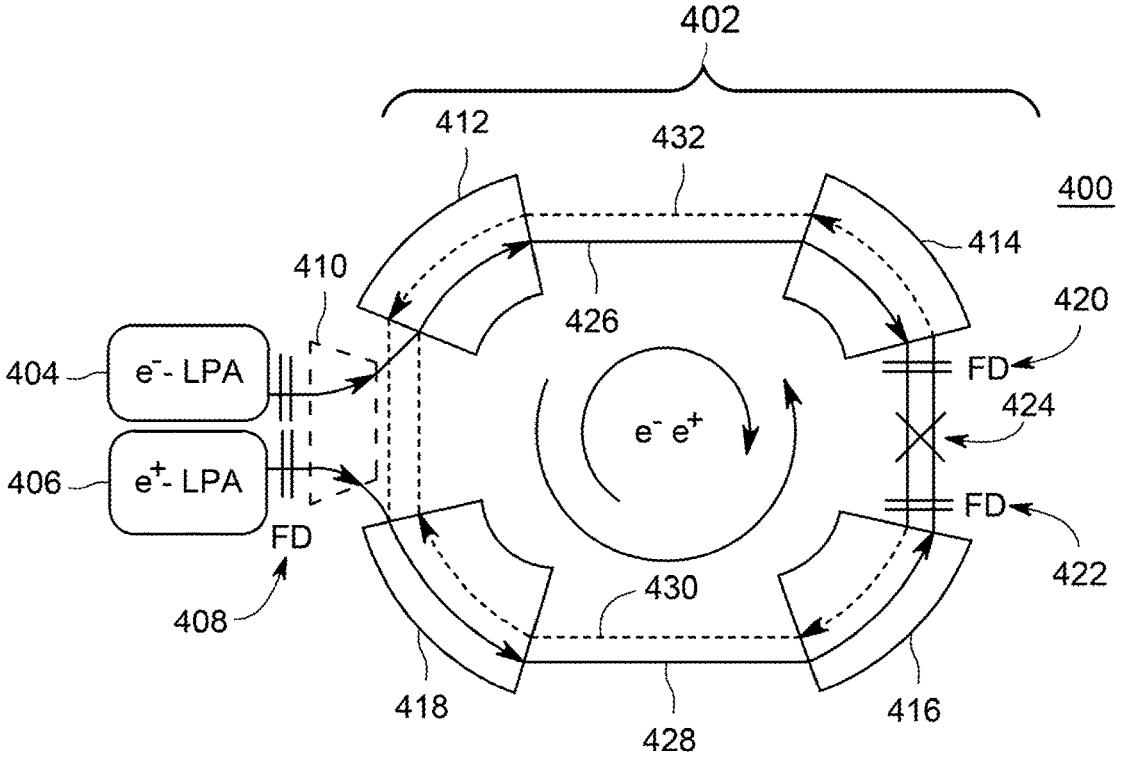
FIG. 4A depicts an apparatus for generating muons, according to an embodiment of the present invention.

FIG. 4A depicts an apparatus 400 for generating muons, according to an embodiment of the present invention. The generated muons may be sub millimeter bunch length pairs of positive and negative muons. The apparatus 400 comprises a source 404 of an electron beam 426 and a source 406 of a positron beam 428. For example, the sources 404, 406 include the laser-driven plasma apparatus (LPA) 10, 20, 30 or a combination of the various processing stages described herein, with an electromagnetic particle shower received from any of the feeder stages described herein, or generally known in the art for generating particle showers. The sources 404, 406 generate the electron beams 426 and the positron beam 428, respectively, in a parallel orientation. The apparatus 400 comprises two focusing doublets 408 downstream of the sources 404, 406 for collimating the beams 426, 428; a bending magnet 410, positioned downstream of the focusing doublets 408, for separating the two beams 426, 428 in two opposite directions; and a unit 402 for directing the beams 426, 428 in a loop. The unit 402 comprises bending magnets 412, 414, 416, 418 positioned at rectangular vertices, for bending the beams 426, 428 to turn about 90 degrees, thereby forming a loop, as seen in FIG. 4A; and focusing doublets 420 and 422, spaced apart and positioned in between the bending magnets 414 and 416, or between any other pair of bending magnets as desired.

As shown, each of the electron beam 426 and the positron beam 428 passes through a respective focusing doublet 408, which collimates the respective beams 426, 428 that are divergent with a small opening angle. Thereafter, the beams 426, 428 encounter the magnetic field of the bending magnet 410, which separates the electron beam 426 and the positron beam 428 in opposite directions, and towards the magnetic fields of the magnets 414 and 418, respectively. The electron beam 426 encounters the magnetic field of the magnet 412, which directs the beam 426 to the magnetic field of the magnet 414. Similarly, the positron beam 428 encounters the magnetic field of the magnet 418, which directs the beam 428 to the magnetic field of the magnet 416. The magnet 414 and the magnet 416 directs the electron beam 426 and the positron beam 428, respectively, towards the other beam to collide the beams 426, 428. The beam 426 first encounters the focusing doublet 420, which focuses the beam 426, for example, between 1 nm to 50 nm, and the beam 428 first encounters the focusing doublet 422 focuses the beam 428, for example, between 1 nm to 50 nm. The collision occurs at position 424, generating other relativistic particles, including a yield of negative and positive muons between 50 to 10000 muons per collision which depends upon the number of positrons and electrons colliding and the beam dimensions at collision.

Since all the particles of the beams 426, 428 do not collide, and several particles of the focused beams simply pass through each other without collision or significant deflection, the beams 426, 428 get collimated in the opposite doublets and continue through the apparatus 400 as follows. For clarity, the beams after collision, the electron beam 426 is shown in broken lines as electron beam 430, and positron beam 428 is shown in broken lines as positron beam 432, in FIG. 4A.

The beams 430, 432 travel straight in between the magnets 414, 416, and after collision, encounters the focusing doublet 422, which recollimates the beam 430, and encounters the magnetic field of the magnet 416, which directs the beam 430 to the magnetic field of the magnet 418, which directs the beam 430 back to the magnetic field of the magnet 412, thereby forming a loop. Similarly, the beam 432, after collision, encounters the focusing doublet 420, which recollimates the beam 432, and encounters the magnetic field of the magnet 414, which directs the beam 432 to the magnetic field of the magnet 412, which directs the beam 432 back to the magnetic field of the magnet 418, thereby forming a loop. The beams 430, 432 enrich the new beams 426, 428 received from the sources 404, 406, respectively, and the cycle is continued as long as a yield of muons is desired.

In one embodiment, for example, as shown in FIG. 4A, the apparatus 400 utilizes two separate sources (e.g. 404, 406) for the production of hundreds of MeV tunable energy electron and positron beams, respectively. In one embodiment, the separate sources 404, 406 generate beams 426, 428 at different energy levels.

Figure 4B:
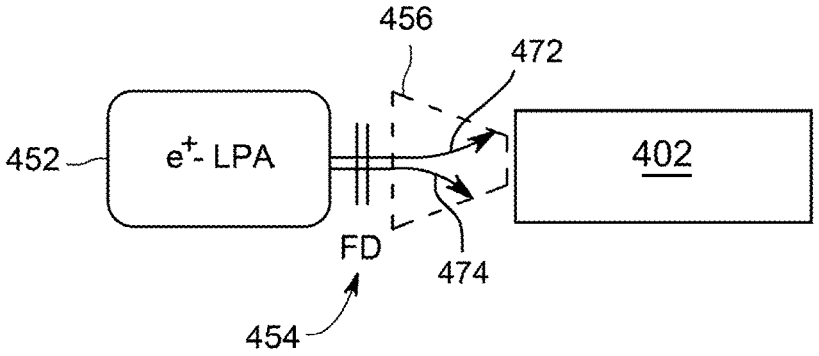
FIG. 4B depicts an apparatus for generating muons, according to an embodiment of the present invention.

FIG. 4B depicts an apparatus 450 for generating muons, according to an embodiment of the present invention. The apparatus 450 comprises a single source 452 of an electron beam 472 and a positron beam 474. For example, the source 452 includes the laser-driven plasma apparatus (LPA) 10, 20, 30 or a combination of the various processing stages described herein, with an electromagnetic particle shower received from any of the feeder stages described herein, or generally known in the art for generating particle showers. The source 452 generates the beams 472 and 474 in a parallel orientation. The apparatus 450 comprises one focusing doublet 454 downstream of the source 452 for focusing the beams 472, 474; a bending magnet 456, positioned downstream of the focusing doublet 454, for diverging the two beams 472, 474; and the unit 402 as described with respect to FIG. 4A. In this embodiment, the apparatus 450 utilizes a single source (e.g. 452) for generation of both the electron and positron beams (472, 474), which are approximately at the same energy levels.

Figure 5A:
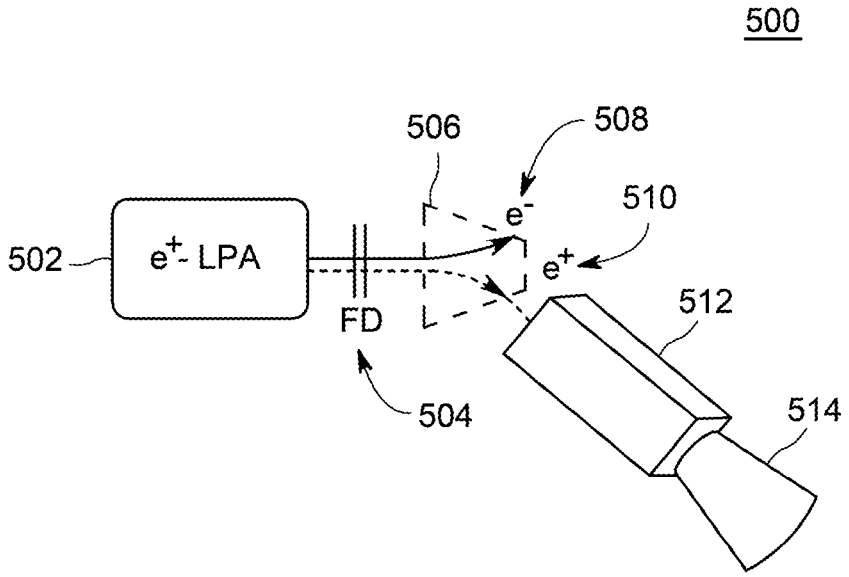
FIG. 5A depicts an apparatus for generating ultrashort channeling radiation, according to an embodiment of the present invention.

FIG. 5A depicts an apparatus 500 for generating ultrashort channeling radiation, according to an embodiment of the present invention. The apparatus 500 comprises a source of a positron beam 502, for example, the laser-driven plasma apparatus (LPA) 10, 20, 30 or a combination of the various processing stages described herein, with an electromagnetic particle shower received from any of the feeder stages described herein, or generally known in the art for generating particle showers. The LPA source 502 generates an electron beam 508 and a positron beam 510. The apparatus 500 comprises a focusing doublet 504 downstream of the source 502, and a bending magnet 506 positioned downstream of the focusing doublet 504, for diverging the two beams 508, 510. The bending magnet 506 directs the positron beam 510 to a crystal channeling undulator 512, which generates a high-energy photon flux 514.

Figure 5B:
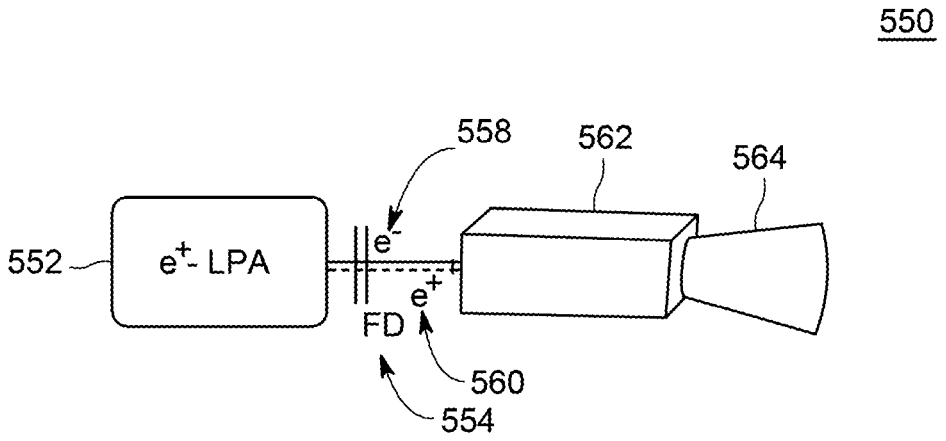
FIG. 5B depicts an apparatus for generating ultrashort channeling radiation, according to an embodiment of the present invention.

FIG. 5B depicts an apparatus 550 for generating ultrashort channeling radiation, according to an embodiment of the present invention. The apparatus 550 comprises a source of a positron beam 552, for example, the laser-driven plasma apparatus (LPA) 10, 20, 30 or a combination of the various processing stages described herein, with an electromagnetic particle shower received from any of the feeder stages described herein, or generally known in the art for generating particle showers. The source 502 generates an electron beam 558 and a positron beam 560. The two beams 558, 560 pass through a focusing doublet 554 downstream of the source 552, and enter into a crystal channeling undulator 562, which generates a high-energy photon flux 564.

The ultrashort channeling radiation source, for example, the source 502 or the source 552, which uses a relativistic particle beam, for example, the positron beam 510, or the electron and positron beams 558, 560 incident from the processing stage on a crystal lattice, for example the undulator 512 or the undulator 562, works using the periodic ionic fields of the lattice where the ions in each lattice plane are in the form of a sheet of positive charge. The periodicity of the lattice ionic field increases for a relativistically propagating electron or positron beam due to Lorentz contraction by a factor of $\gamma$. When the relativistic ultra-short positron or electron beam propagates parallel to a lattice plane, its particles oscillate under the influence of the ionic field about the lattice plane in quantum states normal to the plane. The transition between different quantum states results in the emission of channeling radiation, for example, as discussed in M. A. Kumakhov, *Phys. Lett. A* 57, 17 (1976), hereby incorporated by reference in its entirety. The emission of channeling radiation ranges from soft x-rays (few keV photons) to hard x-rays (many tens of keV photons). The radiated photon energy scales roughly as $\gamma^2$, and therefore, it is beneficial to accelerate the particle beam to a high energy. The photons are emitted in a relatively narrow spectral peak, and the number of photons is at least 10 times higher than the bremsstrahlung photon number.

According to an embodiment, in FIG. 5A, the crystal undulator 512 can be replaced with any sample (biological, metal, semiconductor, or any subject for non-invasive imaging). According to an embodiment, in FIG. 5B, the crystal undulator 562 can be replaced with any sample (biological, metal, semiconductor, or any subject for non-invasive imaging). In such embodiments, a standard methodology to use the positron bunch accelerated in the processing stage to probe a wide variety of materials. This methodology uses the fact that most materials have distribution of free electron density. When the positron beam is incident onto a small spot of the sample, the beam positrons annihilate with the electrons in the sample. This annihilation results in the emission of a pair of gamma ray photons. The number of gamma-ray photons emitted enables the mapping of the electron density in the sample by scanning the positron beam. Production of high energy positron beam as described in this invention enables deeper penetration of the positrons into the sample and thus makes deeper annihilation probing possible. The co-propagating electron bunch may be used for excitation of the sample or in a different configuration the electron beam may be separated.

Various embodiments described hereinabove may be placed in high vacuum ($10^{-3}$ Torr-$10^{-7}$ Torr). Further, various embodiments and components described herein may be combined in different permutations to arrive at apparatus or methods within the scope of the appended claims. For example, processing stage of one embodiment, may be combined with a feeder stage of another embodiment and vice versa. Furthermore, the processing stages described herein may be combined with any number of feeder stages capable of generating particle shower.

The methods described herein may be implemented in software, hardware, or a combination thereof, in different embodiments. In addition, the order of methods may be changed, and various elements may be added, reordered, combined, omitted or otherwise modified.

All examples described herein are presented in a non-limiting manner. Various modifications and changes may be made as would be obvious to a person skilled in the art having benefit of this disclosure. Realizations in accordance with embodiments have been described in the context of particular embodiments. These embodiments are meant to be illustrative and not limiting. Many variations, modifications, additions, and improvements are possible. Accordingly, plural instances may be provided for components described herein as a single instance. Other allocations of functionality are envisioned and may fall within the scope of claims that follow. Finally, structures and functionality presented as discrete components in the example configurations may be implemented as a combined structure or component. These and other variations, modifications, additions, and improvements may fall within the scope of embodiments as defined in the claims that follow.

While the foregoing is directed to embodiments of the present invention, other and further embodiments of the invention may be devised without departing from the basic scope thereof, and the scope thereof is determined by the claims that follow.

The invention claimed is:

1. A method for processing a particle shower using a laser-driven plasma, the method comprising:

interacting a particle shower with a processing laser-driven plasma stage, the particle shower comprising at least two particle species, wherein the laser is a high-energy, ultra-short pulse laser.

2. The method of claim 1, further comprising:

at least one of accelerating, decelerating, trapping, or collimating the at least one particle species in the processing laser-drive plasma stage.

3. A method for processing a particle shower using a laser-driven plasma in a processing laser-driven plasma stage, the method comprising:

driving a processing laser into a processing laser-driven target to form a tunable processing laser-driven plasma in the processing laser-driven target; and interacting a particle shower with the processing laser-driven plasma, the particle shower comprising at least two particle species, wherein the processing laser is a high-energy, ultra-short pulse laser.

4. The method of claim 3, wherein the processing laser-driven plasma stage comprises a laser-driven target, the target comprising at least one of a gas, a liquid, or a metal.

5. The method of claim 3, further comprising:

obtaining two beams of two oppositely charged particle species; and influencing the at least two beams to diverge from each other by influencing the at least two beams with a second magnetic field.

6. The method of claim 5, further comprising:

directing each of the two diverged beams to orient in a head on orientation with the other;

colliding the two beams; and generating muons as an outcome of the collision.

7. The method of claim 5, wherein one of the two beams comprises a positron beam, the method further comprising:

directing the positron beam to a crystalline material; and generating ultra-short radiation from the interaction.

8. The method of claim 3, further comprising generating the particle shower in a feeder stage, the feeder stage comprising:

driving a feeder gas target using a feeder laser;

generating an electron flux or a proton flux from the feeder laser-driven gas target; and interacting the electron flux or the proton flux with a metal target to generate the particle shower.

9. The method of claim 3, wherein the particle shower is generated in a feeder stage, the feeder stage comprising:

driving a feeder metal target using a feeder laser, wherein a pre-pulse of the feeder laser generates a pre-plasma ahead of the arrival of a main pulse of the feeder laser; and generating the particle shower from the metal target.

10. The method of claim 3, further comprising:

obtaining at least one beam of the at least one particle species, wherein the at least one particle species comprises of positrons or muons.

11. The method of claim 3, further comprising:

tuning the tunable processing laser-driven plasma; and at least one of accelerating, decelerating, trapping, or collimating the at least one particle species in the processing laser-drive plasma.

12. The method of claim 11, wherein the accelerating comprises:

accelerating the at least one particle species to a peak energy spectrum at least twice the peak energy spectrum of the particle shower.

13. The method of claim 11, wherein the collimating comprises:

collimating the at least one particle species to a divergence at least half of the divergence of the particle shower.

14. The method of claim 11, wherein the particle shower is either an electromagnetic particle shower comprising at least electrons and positrons, or a hadronic particle shower comprising at least pions and muons.

15. The method of claim 14, further comprising:

providing a first magnetic field to reduce the divergence of the particle shower prior to the interacting.

* * * * *